United States Patent [19]

Nichols

[11] Patent Number: 4,928,922

[45] Date of Patent: May 29, 1990

[54] BUTTERFLY DISCHARGE VALVE ASSEMBLY FOR A LIQUID BULK CONTAINER

[75] Inventor: Dwight E. Nichols, Beatrice, Nebr.

[73] Assignee: Hoover Group, Inc., Alpharetta, Ga.

[21] Appl. No.: 435,690

[22] Filed: Nov. 13, 1989

[51] Int. Cl.[5] ..... F16K 1/22

[52] U.S. Cl. ..... 251/180; 251/315

[58] Field of Search ..... 251/176, 180, 185, 305, 251/306

[56] References Cited

U.S. PATENT DOCUMENTS

| | | | |
|---|---|---|---|
| 2,923,523 | 2/1960 | Taylor | 251/306 X |
| 3,214,132 | 10/1965 | Coldthorpe | 251/306 X |
| 4,717,120 | 1/1988 | Fremow et al. | 251/306 X |

*Primary Examiner*—John C. Fox

*Attorney, Agent, or Firm*—Harness, Dickey & Pierce

[57] ABSTRACT

A butterfly valve assembly for use in connection with liquid bulk containers. An annular discharge passage houses an annular valve member moveable within the discharge passage between open and closed positions. An annular groove in close proximity to the periphery of the valve member is included on a first side of the valve member. A compressible resilient, thermoplastic rubber material in the form of a sealing ring is disposed within the groove and allows an annular edge surface of the valve member to be deflected inwardly relative to the annular groove when the valve member is rotated to the closed position. A manually grippable knob and a shaft attached between the knob and the valve member allows the valve member to be manually moved between the open and closed positions.

11 Claims, 3 Drawing Sheets

BUTTERFLY DISCHARGE VALVE ASSEMBLY FOR A LIQUID BULK CONTAINER

BACKGROUND OF THE INVENTION

1. Technical Field

The present invention relates to valve assemblies and, more particularly, to a butterfly discharge valve assembly for use with liquid bulk containers.

2. Discussion

Valve assemblies are useful in a wide variety of applications where the flow of liquids or semi-solids must be controlled or interrupted. In particular, discharge valves are useful when used in connection with liquid bulk containers. Such containers typically may store up to 350 gallons or more of liquid material. Due to their large size and weight, such containers are not easily tipped or otherwise turned upside down for drainage purposes. As such, a discharge valve located at or near the bottom of such a container is extremely useful in allowing such a container to be drained quickly and easily without having to tilt or tip the container at various angles to accomplish evacuation of its contents. An example of a large, liquid bulk container is disclosed in U.S. Pat. No. 4,793,519, to Voorheis, Jr., issued Dec. 27, 1988, assigned to the assignee of the present invention.

Since liquid bulk containers are not easily evacuated by means other than a valve at or near their bottom or base portions, it becomes important to have a valve assembly that provides a leak-proof seal. A discharge valve which leaks could seriously compromise the efficiency of a liquid bulk container, since the container might have to be immediately evacuated or other measures taken to control the leakage.

It is therefore a principal object of the present invention to provide a valve assembly capable of providing a leak-proof seal for the contents of a large, liquid bulk container.

It is a further object of the present invention to provide a valve assembly which is capable of being opened and closed relatively quickly and easily in the event that a discharge of the contents of such a container must be interrupted quickly for any reason.

It is still a further object of the present invention to provide a valve assembly which may be manufactured relatively easily and inexpensively so as to permit disposal of the valve assembly along with the container if disposal of the container is so desired.

SUMMARY OF THE INVENTION

The above and other objects are provided by a butterfly discharge valve assembly in accordance with the present invention. The valve assembly comprises a discharge passage having an inner wall of generally circular cross-section which may be integrally formed with a portion of a liquid bulk container for allowing liquid or other semi-solid material to be discharged therethrough. A valve member of substantially disc shape is disposed within the discharge passage and moveable between open and closed positions. The valve member is slightly larger in diameter than the inner wall of the discharge passage and is moveable in the discharge passage between open and closed positions to control the discharge of liquid through the discharge passage and to quickly interrupt the discharge if necessary. The valve member has opposite side faces, a sealing edge surface and a groove in one of the faces at a position in close proximity with the edge surface. A compressible, resilient material substantially fills the groove and enables the edge surface to be deflected inwardly toward the groove by the inner wall of the discharge passage when the valve member is moved into the closed position. The compressible, resilient material and the groove thus coact to enable the edge surface to make a leak-proof seal with the inner wall of the discharge passage when the valve member is in the closed position. A control knob for allowing manual movement of the valve member between the open and closed positions is also included.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
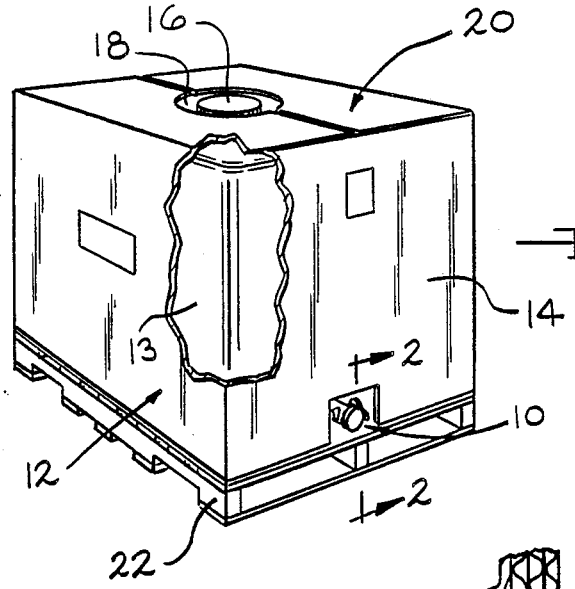
FIG. 1 is a perspective view of a liquid bulk container equipped with the butterfly discharge valve assembly of the present invention.

A butterfly discharge valve assembly 10 in accordance with the present invention is shown in FIG. 1 in assembly relation with a liquid bulk container 12. The container 12 has an outer shell 14 preferably of a rigid material such as corrugated paper material which is readily available from corrugated box manufacturing companies. A unitary blow-molded plastic inner tank 13 is disposed within the outer shell 14 of the container 12 and positioned in an upright fashion so that a top fill cap 16 on the inner tank projects through an opening 18 in a top surface 20 of the container 12. A pallet 22 may also be included to facilitate movement of the container 12 by the tines of a forklift.

The forgoing has been intended as a general description only of a liquid bulk container with which the valve assembly 10 of the present invention may be used. Specific details of the construction and operation of a liquid bulk container may be found in U.S. Pat. No. 4,793,519 the disclosure of which is hereby incorporated by reference.

Figure 2:
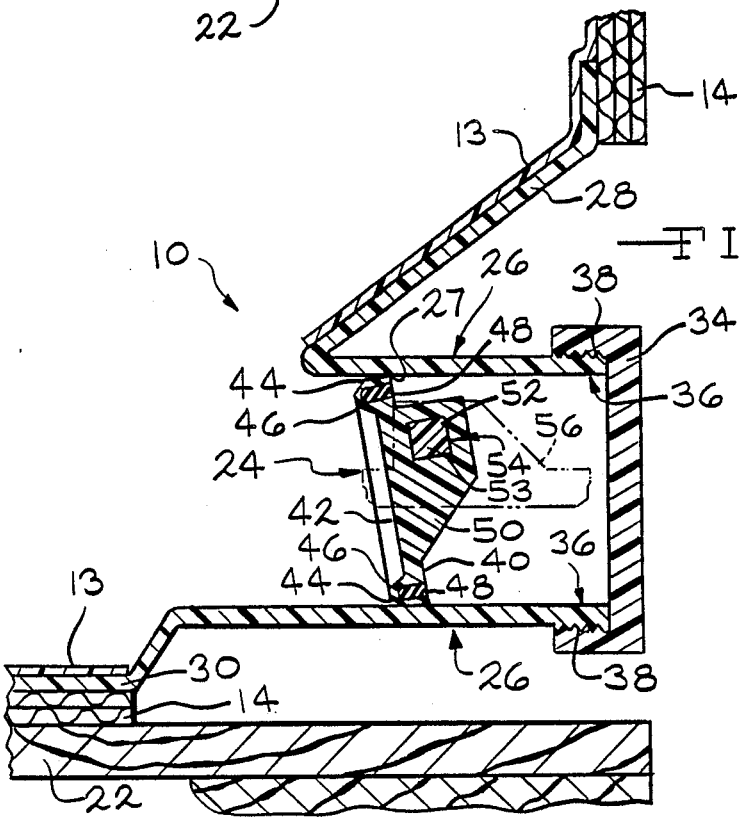
FIG. 2 is an enlarged, fragmentary, sectional view of the butterfly discharge valve assembly as seen from substantially the line 2—2 in FIG. 1.
Figure 3:
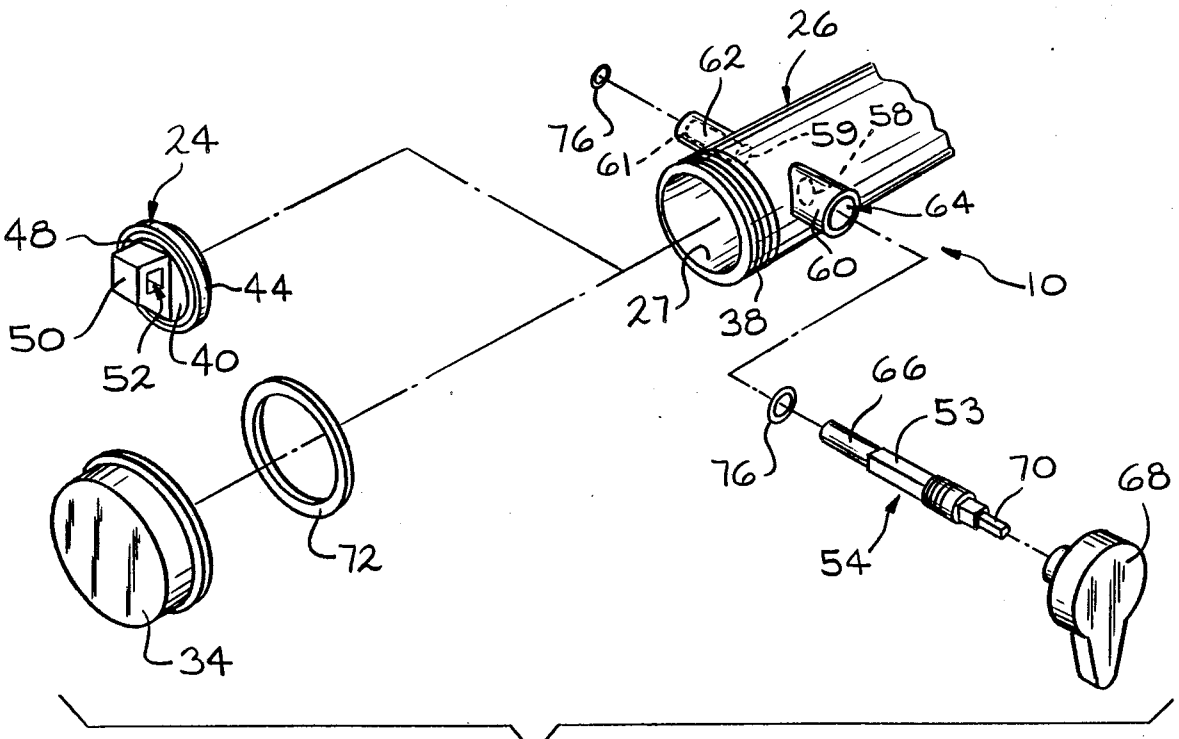
FIG. 3 is an exploded, perspective view of the butterfly discharge valve assembly.

The valve assembly 10 generally comprises an annular valve member 24 disposed within an elongated, annular discharge passage 26 having an inner wall 27, as shown in FIGS. 2 and 3. Integrally formed with the discharge passage 26 is a frame member 28. The frame member 28 is adapted to be heated with a portion of the inner tank 13 adjacent the frame member 28 to form a leak-proof seal with the inner tank 13. An opening is then punctured or otherwise cut in a portion of the inner tank 13 which covers the discharge passage 26 to allow the liquid contents of the inner tank 13 to drain through the passage 26. A bottom portion 30 of discharge passage 26 may similarly be attached to a lower portion 32 of the outer shell 14 of the container 12. A removable, threaded end cap 34 may also be included for further protecting against leakage and inadvertent damage to the valve member 24 during transportation of the container 12. If threaded end cap 34 is used, an end portion 36 of the discharge passage 26 will likewise need to be threaded, as indicated at 38, to permit threading engagement of the locking cap 34 with the end portion 36 of the discharge passage 26.

The valve member 24 has first and second opposing sides 40 and 42 respectively and a semi-annular edge surface 44. An annular groove 46 is included in the first side 40 of the valve member 24 and contains a compressible, resilient, annular body or ring 48 adapted to rest nestably within the groove 46 and substantially flush with the first side 40. The valve member 24 is further of a diameter slightly larger than the inner wall 27 of the discharge passage 26.

Integrally formed with the first side 40 of the valve member 24 is an outwardly protruding shoulder portion 50 having a generally square opening 52. The opening 52 receives a generally square portion 53 of an elongated shaft 54, which allows the valve member 24 to be rotatably moved to an open position, as shown by phantom line 56. Specific details of the shaft 54 and its operation will be discussed momentarily in connection with the drawing of FIG. 3.

The discharge passage 26 and frame member 28 may be made from a wide variety of materials but is preferably made from a rigid material to form a unitary structure. Polyethylene is particularly suitable due to its high temperature resistance, its high impact and tensile strength, its insolubility in organic solvents, and its resistance to stress-cracking. The valve member 24 is also preferably formed from polyethylene. The sealng ring 48, however, is preferably made from a thermoset elastomer which is resilient and compressible to enable it to be compressed slightly during opening and closing of the valve member 24. A particularly desirable material for this purpose is "Santoprene", a thermoplastic rubber available from the Monsanto Company (Santoprene is a registered trademark of the Monsanto Company). It should be appreciated, however, that a wide variety of materials having resilient, compressible properties may be used for the sealing ring 48 provided such materials will not be affected by the liquids the container 12 is used to hold. The end cap 34 may also be manufactured from a wide variety of materials, but is preferably injection molded from a material similar to that of the discharge passage 26.

In operation, as the valve member 24 rotates from its open position, indicated by phantom line 56, to its generally closed position, as shown in FIG. 2, edge surface 44 will come into abutting contact with the inner wall 27 of discharge passage 26. As the valve member 24 is rotatably urged into its fully closed position the compressible sealing ring 48 enables edge surface 44 to be deflected inwardly slightly by the inner wall 27 which has a diameter slightly less than the diameter of the valve member 24. The ability of the edge surface 44 to be deflected inwardly by the inner wall 27 effects a tighter and more leak-proof seal between the entire periphery of the edge surface 44 and the inner wall 27 while maintaining the ease of operation and quick opening and closing ability which a butterfly valve-type member provides. The resilient nature of sealing ring 48 further enhances the ability of the valve member 24 to provide a leak-proof seal after many opening and closing movements of the valve member 24.

In FIG. 3 the component parts of the valve assembly 10 are shown with the valve assembly 10 in a disassembled condition. The discharge passage 26 includes first and second coaxially disposed and protruding bosses 60 and 62 respectively. The first boss 60 includes an annular opening 64 which extends through coaxial, annular openings 58 and 59, discharge passage 26 and into an annular, recessed portion 61 of the second boss 62. The shaft 54 includes an annular end portion 66 which is adapted to be inserted into opening 64 and rest nestably within the recessed portion 61 within the second boss 62. When the shaft 54 is inserted into and through opening 64 of the first boss 60, a square portion 53 of the shaft 54 will extend through the square opening 52 of the valve member 24, thus forming a key-like arrangement with the square opening 52 to allow the valve member 24 to be rotated when the shaft 54 is rotated.

To facilitate rotation of the shaft 54, a grippable knob 68 is included. The knob 68 includes a generally square recessed portion, not shown, which receives in a key-like fashion a generally square end portion 70 of shaft 54. Thus, the valve member 24 may be rotated into open and closed positions by gripping and manually turning or rotating the knob 68 in clockwise and counterclockwise directions.

The valve assembly 10 may also include an annular, sealing-type washer 72 for further helping to provide a leak-proof seal between end cap 34 and the threaded end 38 of the discharge passage 26. Similarly, washers 74 and 76 may also be included to help facilitate a smoother rotating action of the shaft 54 during opening and closing movements of the valve assembly 10, and/or to help provide a leak-proof seal where the shaft 54 interfaces with the discharge passage 26.

Figure 5:
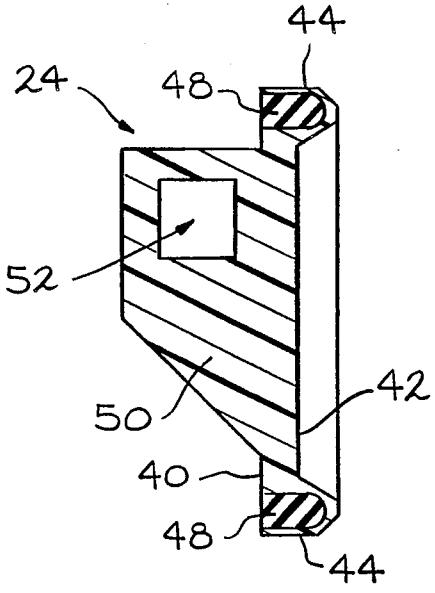
FIG. 5 is a sectional view of the valve member taken along the line 5—5 in FIG. 4.
Figure 4:
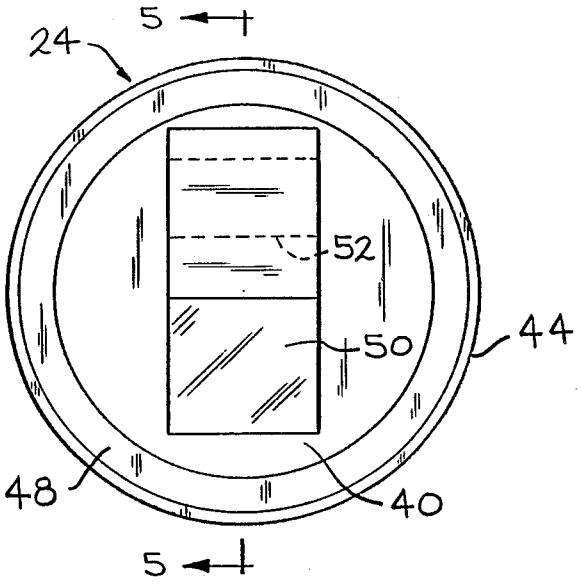
FIG. 4 is an elevational view of one side of the valve member in the valve assembly.

In FIG. 4 a plan view of the valve member 24 is illustrated showing more clearly the annular shape of the valve 24 and the annular sealing ring 48. In FIG. 5, a sectional view of the valve member 24 is shown. From FIG. 5 the generally curved nature of the edge surface 44 can be seen more clearly.

The butterfly discharge valve assembly of the present invention is thus well calculated to provide discharge of the contents of a liquid bulk container. The valve assembly 10 allows the contents of such a container to be stored without leakage, to be quickly and easily discharged, or the discharge of such contents to be quickly and easily interrupted, without tilting, tipping or other like movements of the container.

Although the present invention has been illustrated in accordance with specific examples thereof, it should be appreciated that modifications may be made to the present invention by those skilled in the art without departing from the true and fair scope of the subjoined claims.

What is claimed is:

1. In a liquid bulk container, a butterfly discharge valve assembly comprising:

a body member having a discharge passage in fluid communication with said container and having an inner wall of generally circular cross-section, said discharge passage being operable to allow liquid from a liquid bulk container to be discharged therethrough;

a valve member of substantially disc shape disposed within said discharge passage, said valve member having opposite side faces and being of a diameter slightly larger than the diameter of said inner wall of said discharge passage, said valve member being moveable in said passage between open and closed positions, said valve member having a sealing edge surface and a groove in one of said faces at a position in close proximity to said edge surface; and compressible, resilient material substantially filling said groove for enabling said edge surface to be deflected inwardly toward said groove by said inner wall when said valve member is moved into said closed position, said groove and said sealing edge surface coacting to effect a leak-proof seal between said edge surface and said inner wall when said valve element is moved into said closed position.

2. The valve assembly of claim 1, wherein said valve member is a polyethylene member.

3. The valve assembly of claim 1, further including means for manually moving said valve member between said open and closed positions.

4. For a liquid bulk container, a butterfly discharge valve assembly comprising:

discharge passage means having an inner wall for allowing liquid to be discharged therethrough;

a valve member disposed within said discharge passage means and moveable between open and closed positions for controlling the discharge of liquid through said discharge passage means, said valve member having first and second opposing surfaces and an edge surface substantially orthogonal to said first and second surfaces, said first surface having a groove in close proximity to its periphery;

means for allowing manual movement of said valve member between said open and closed positions; and a body disposed in said groove formed of a material of greater resilience than the material of which said valve member is formed to thereby enable said edge surface of said valve member to be deflected inwardly slightly relative to said groove by said inner wall of said discharge passage means when said valve member is moved into said closed position, said body and said groove thereby coacting to allow said edge surface to make a leak-proof seal with said inner wall of said discharge passage means when said valve member is in said closed position.

5. The butterfly discharge valve assembly of claim 4, wherein said discharge passage means forms a cylindrical, tubular discharge passage.

6. The butterfly discharge valve assembly of claim 4, wherein said means for manually moving said valve member comprises:

a manually grippable knob;

an elongated shaft secured to said knob, said discharge passage means having a pair of opposingly facing apertures therein for receiving therethrough the shaft;

a shoulder portion attached to said valve member, said shoulder portion having an opening for receiving therethrough in a keyed fashion said shaft, whereby manual, rotational movement of said knob causes said shaft to rotate, which in turn causes said valve member to rotate to open and closed positions.

7. The butterfly discharge valve assembly of claim 4, wherein said body is an annular, thermoplastic rubber sealing ring.

8. In a liquid bulk container, a butterfly discharge valve assembly comprising:

an annular discharge passage having inner and outer walls, said discharge passage being operable to allow liquid from a liquid bulk container to be discharged therethrough;

an annular, valve member disposed within said discharge passage, said valve member being of a diameter slightly larger than a diameter of said inner wall of said discharge passage and moveable within said discharge passage between open and closed positions, said valve member further havng first and second substantially parallel and opposing surfaces and an annular edge surface substantially orthogonal to said first and second surfaces;

said first surface having an annular groove in close proximity to its periphery and near said edge surface;

means for allowing manual, rotational movement of said valve element between said open and and said closed positions; and a compressible, resilient annular sealing ring disposed within said groove, said sealing ring being operable to allow said edge surface of said valve element to be deflected inwardly slightly relative to said annular groove by said inner wall of said discharge passage when said valve element is moved into said closed position, said sealing ring and said annular groove thereby coacting to allow said edge surface to make a leak-proof seal with said inner wall of said discharge passage when said valve member is in said closed position.

9. The butterfly discharge valve assembly of claim 8, wherein said means for allowing manual, rotational movement of said valve element comprises:

a manually grippable knob;

an elongated shaft attached to said knob;

and wherein said discharge passage has a pair of coaxially disposed openings, said openings being operable to receive said shaft;

and wherein said valve member has an outwardly protruding shoulder portion having an opening therethrough disposed coaxially with said openings in said discharge passage, said openings in said shoulder portion being operable to receive said shaft and rotate said valve member into said open and closed positions when said knob is turned.

10. The butterfly discharge valve assembly of claim 8, wherein said sealing ring is an annular, thermoplastic rubber sealing ring.

11. The butterfly discharge valve assembly of claim 8, wherein said discharge passage comprises:

a threaded end; and a locking cap, said threaded end being operable to threadably receive said locking cap thereon to thereby insure against leakage when said valve member is in said closed position.

* * * * *